United States Patent [19]

Ward

[11] Patent Number: 4,499,635

[45] Date of Patent: Feb. 19, 1985

[54] SHADECLOTH FIXING PIN

[76] Inventor: Connie T. Ward, Lot No. 1699, McKinnin Rd., Darwin, Northern Territory, Australia

[21] Appl. No.: 473,455

[22] Filed: Mar. 9, 1983

[30] Foreign Application Priority Data

Aug. 24, 1982 [AU] Australia ..... 525606

[51] Int. Cl.[3] ..... A44B 9/00

[52] U.S. Cl. ..... 24/150 R; 24/150 B; 24/152; 24/156; 24/562

[58] Field of Search ..... 24/150 R, 150 B, 150 P, 24/152, 156, 562

[56] References Cited

U.S. PATENT DOCUMENTS

| | | | |
|---|---|---|---|
| 280,118 | 6/1883 | Bates | 24/150 B |
| 517,725 | 4/1894 | Bornstein | 24/150 R |
| 570,838 | 11/1896 | Bolton et al. | 24/152 |
| 1,405,500 | 2/1922 | Dahl | 24/150 P |
| 1,421,037 | 6/1922 | Speck | 24/150 P |
| 1,488,841 | 4/1924 | Scott | 24/150 R |
| 1,661,165 | 3/1928 | Cameron | 24/150 R |
| 1,712,531 | 5/1929 | Torelli | 24/150 R |
| 2,015,149 | 9/1935 | Krzeminski | 24/150 R |
| 3,119,163 | 1/1964 | Merfeld | 24/562 |
| 3,382,547 | 5/1968 | Hoefer | 24/150 R |

*Primary Examiner*—Victor N. Sakran

*Attorney, Agent, or Firm*—Pearne, Gordon, Sessions, McCoy, Granger & Tilberry

[57] ABSTRACT

A shadecloth stitching pin for joining shadecloth to temporary or permanent fixtures or to itself. The pin includes a pointed end to pass through the cloth and gripping means to prevent the pin withdrawing from the cloth.

4 Claims, 1 Drawing Figure

SHADECLOTH FIXING PIN

Figure 1:
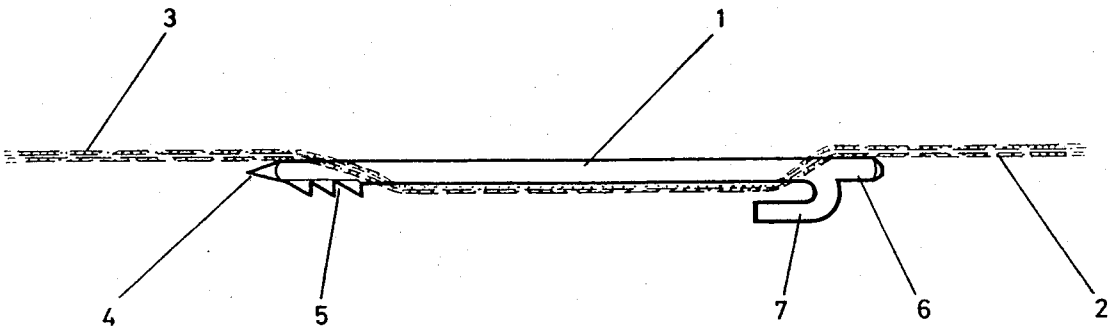

This invention relates to shade cloth, and more particularly to a pin for joining overlapping portions of shade cloths.

Shade cloth is used by nursery businesses and private gardeners for a sun protective awning. The cloth can be sewn and stitched to the correct dimensions by professional makers. However, often the purchaser wishes to cut and join the cloth to their own particular requirements.

Materials are available for this, the binding tape and thread required being readily available. However this is a time consuming process, and while it is suitable for a permanent type installation, a quicker method is desired for the production, not only for temporary installations, but also for permanent type installations.

Thus there is provided according to this invention a shade cloth stitch pin for joining overlapped portions of shade cloth, the pin having an elongate body portion, a tapered or pointed end on one end of the body portion, gripping means on the body portion adjacent the pointed end to grip and retain the shade cloth, and an abutment member to engage the cloth on the body toward the opposite end of the pin, the abutment member facing the pointed end and being positioned on the same side of the pin as the gripping means, whereby when the pin is inserted through the overlapped portions of shade cloth, and the point again reinserted to be on the same side of the overlapped portions as the abutment means, that the overlapped portions are retained on the pin by the gripping means and the abutment member engaging on the shade cloth.

In order to more fully describe the invention reference will now be made to the accompanying drawing showing a stitch pin connecting two pieces of shade cloth.

The single drawing shows a stitch pin 1 in generally full size joining two overlapping pieces of shade cloth 2–3.

At one end the pin is provided with a pointed end 4 adjacent which is a series of serrated teeth 5. The pin 1, toward its other end is provided with a hook shaped member 7 extending away from the body of the pin 1, and then extending toward the pointed end 4 of the pin 1. This hook shaped member 7 is situated on the same side of the pin 1 as the teeth 5.

In use a plurality of the pins would be used. The shade cloth portions would be overlapped to the required degree, generally 3 to 5 centimeters or more, and the pin is inserted by pushing the end through both portions of shade cloth, moving it along, and then reinserting the end through both layers, in a manner similar to using a dressmakers pin. However the teeth 5 are passed through both layers of shade cloth, and then the teeth 5 and the hook 7 lock and locate the pin in position to prevent removal during flapping and movement of the wind. The cloth portions are intended to be inserted fairly taut, and thus the pins are securely held during wind movement. The hook member prevents the pin from rotating so insuring that the teeth are in the engaging position.

However it is relatively easy to manually remove the pins when desired by bending of the cloth and applying pressure on the cloth by the side of the pin opposite the teeth to open slightly the weave of the shade cloth.

The teeth 5 can vary in number, and also the hook 7 can also be varied as desired to be either parallel as illustrated, or can be gently curved or arcuate over its whole length sufficient for it to form a small gap to receive the shade cloth.

The pin can be formed of any suitable material but preferably is formed of a suitable plastics material by moulding or injection moulding processes. The body of the pin is preferably cylindrical, but can be either oval, square or rectangular in section as desired.

In an alternative form the teeth at the pointed end can be replaced by a small hook member suitable for passing through the mesh of the shade cloth.

Although one form of the invention has been described it will be appreciated that the invention includes variations falling within the spirit of the appended claim.

The claim defining the invention is as follows.

I claim:

1. A shade cloth stitch pin for joining overlapped portions of tension shade cloth, the pin having an elongate body portion, a tapered or pointed end on one end of the body portion, gripping means on the body portion adjacent the pointed end to grip and retain the shade cloth, and an abutment member to engage the cloth on the body toward the opposite end of the pin, the abutment member facing the pointed end and being positioned on the same side of the pin as the gripping means and having a portion spaced from the pin and extending towards said one end, whereby when the pin is inserted through the overlapped portions of shade cloth, and the point again reinserted to be on the same side of the overlapped portions as the abutment member, that the overlapped portions are retained on the pin by the gripping means and the abutment member engaging on the shade cloth, said portion of the abutment member overlying the shade cloth to prevent rotation of the pin.

2. A stitch pin according to claim 1, wherein said abutment member portion extends partially towards said one end and thereby forms a short hook adjacent said opposite end.

3. A stitch pin according to claim 2, wherein the overlapped portions of the tensioned shade cloth are retained on the pin by said gripping means and said abutment member hooking the tensioned shade cloth at both ends of the pin respectively to prevent separation of the overlapped portions of the tensioned shade cloth.

4. A stitch pin according to claim 1, wherein said gripping means extend from the pin and are adapted to project through the overlapped portions of the shade cloth and with said abutment member prevent relative sliding movement of the overlapped portions of the shade cloth.

* * * * *